United States Patent [19]

Easter

[11] 3,998,052

[45] Dec. 21, 1976

[54] HYDRAULIC TURNING ARRANGEMENT FOR A TURBINE ROTOR

[75] Inventor: Michael J. Easter, Pineville, N.C.

[73] Assignee: Westinghouse Electric Corporation, Pittsburgh, Pa.

[22] Filed: Sept. 3, 1975

[21] Appl. No.: 610,038

[52] U.S. Cl. ..... 60/413; 60/456; 60/486

[51] Int. Cl.[2] ..... ..... F15B 1/02; F15B 13/09

[58] Field of Search ..... 60/413, 428, 429, 456, 60/486

[56] References Cited

UNITED STATES PATENTS

| | | | |
|---|---|---|---|
| 1,634,894 | 7/1927 | Allen | 60/704 |
| 2,074,618 | 3/1937 | Roeder | 60/486 X |
| 2,483,349 | 9/1949 | Petty et al. | 60/486 X |
| 2,526,646 | 10/1950 | Ericson | 60/486 X |
| 2,651,258 | 9/1953 | Pierce | 60/486 X |
| 2,914,908 | 12/1959 | Memmel | 60/486 X |

*Primary Examiner*—Edgar W. Geoghegan
*Attorney, Agent, or Firm*—F. J. Baehr, Jr.

[57] ABSTRACT

A hydraulic arrangement for turning the rotor shaft of an axial flow elastic fluid turbine rotor. The arrangement includes a variable speed hydraulic motor, the torque produced thereby being dependent upon the pressure of motive fluid supplied therethrough. The motor is connected through suitable coupling or clutch to the shaft. A plurality of sources of motive fluid each at a predetermined pressure range are connected to the motor. A flow control arrangement for selectively introducing motive fluid from each of the plurality of sources to the hydraulic motor to provide the desired torque output from the motor is provided.

16 Claims, 4 Drawing Figures

HYDRAULIC TURNING ARRANGEMENT FOR A TURBINE ROTOR

BACKGROUND OF THE INVENTION

1. Field of the Invention

This invention relates to turbine power plants, and in particular, to a hydraulic arrangement for turning the rotor shaft of an axial flow turbine apparatus.

2. Description of the Prior Art

During periods of turbine inoperability or just prior to the starting of the turbine after a long down period, it is the practice in the art to slowly roll the steam turbine rotor in order to minimize the possibility of distortion thereto due to uneven cooling or heating. For this purpose there is usually provided on the turbine rotor shaft a large turning gear. Associated with the turning gear through a suitable speed reducer and gear drive arrangement is an electric motor.

It has been found that the starting torque required to rotate the turbine shaft from rest is much greater than the torque required to keep the shaft in rotation. The electric motor drives which are utilized for present turbine turning gear systems are therefore sized for the maximum torque requirement at starting. These motor drives, however, operate much below their capacity once the turbine rotor has begun to roll and during the slow rolling operation the major portion of the power produced is utilized to overcome the frictional losses in the gear train.

The prior art has reduced the starting torque requirements and turning gear power unit sizes somewhat through the utilization of bearing hydrostatic lifts. These bearing lift systems introduce high pressure oil directly below the turbine shaft in the bearings to reduce the torque required for rotation. The turning gear torque capacity required is still large however, for such contingencies as seal rubs or bearing wipes.

Most electric motor driven systems are operable only at constant speed and to achieve high starting torques, low turning gear speed results. At low turning gear speed, mixed film lubrication of the bearings may result in permanent bearing damage. Therefore, some electric motor driven systems utilize two-speed transmissions to develop the high starting torques necessary initially and to maintain high enough running speeds so as to obtain full film bearing oil lubrication. However, such arrangements are expensive.

In sum, the present electric motor driven systems for providing motive power for the turning of steam turbine rotors leave much to be desired. For example, the requirement of high starting torque coupled with the constant speed operation of most electric motor systems results in a high power loss in the speed reducing arrangement which maintains the rotor rolling after initial start.

The gear train and the speed reducing drives are very expensive. The turning gear itself is costly, subject to wear, and imposes high windage loss on the turbine and oil system when the turbine is at speed. Further, the high in-rush current to the turning gear motor leads to infrequent starting. Of course, overload torque may result in permanent motor coil damage.

It is thus seen that the prior art system utilizing constant speed electric motors associated with speed reducers and gear drives in order to provide slow rolling of steam turbine rotors is both inefficient and uneconomical.

SUMMARY OF THE INVENTION

The hydraulic turbine turning system described herein and embodied in the teachings of this invention provides a low speed, high torque hydraulic motor and a unique hydraulic fluid power supply system which provides higher reliability, simplicity, performance and economy than exhibited by existing systems.

The system comprises a variable speed hydraulic motor operatively coupled to the rotor shaft. The speed of the hydraulic motor is dependent directly upon the flow rate of the motive fluid introduced thereto. A plurality of sources of motive fluid for the hydraulic motor, each source exhibiting a predetermined pressure range and having a predetermined flow range associated therewith are connected through a flow control arrangement. The flow control arrangement selectively introduces motive fluid from each of the plurality of sources to provide the precise flow rate to the hydraulic motor in order to meet the speed requirements of the rotor and shaft. The system is adaptable for direct connection of the hydraulic motor to the turbine shaft or, in the alternative, for connection to the large turning gear mounted on the rotor shaft, but without the use of the reduction gearing and speed reducers of the prior art.

It is an object of this invention to provide a low speed, high torque hydraulic motor and fluid supply system which provide higher reliability and economy than exists in the present systems. Further, it is an object to provide a hydraulic motor and its associated motor fluid system which is operable when either directly coupled to the rotor shaft or else coupled through the turning gear mounted thereon. It is a still further object to provide a hydraulic motor which permits variable speed operation in order to conform to the speed and torque requirements of the turbine rotor both during initial startup and once startup has been achieved. Other objects of the invention will become clear in the detailed description of the preferred embodiment which follows herein.

BRIEF DESCRIPTION OF THE DRAWINGS

The invention will be more fully understood in the following detailed description of the preferred embodiment taken in connection with the accompanying drawings, in which.

DESCRIPTION OF THE PREFERRED EMBODIMENT

Figure 1:
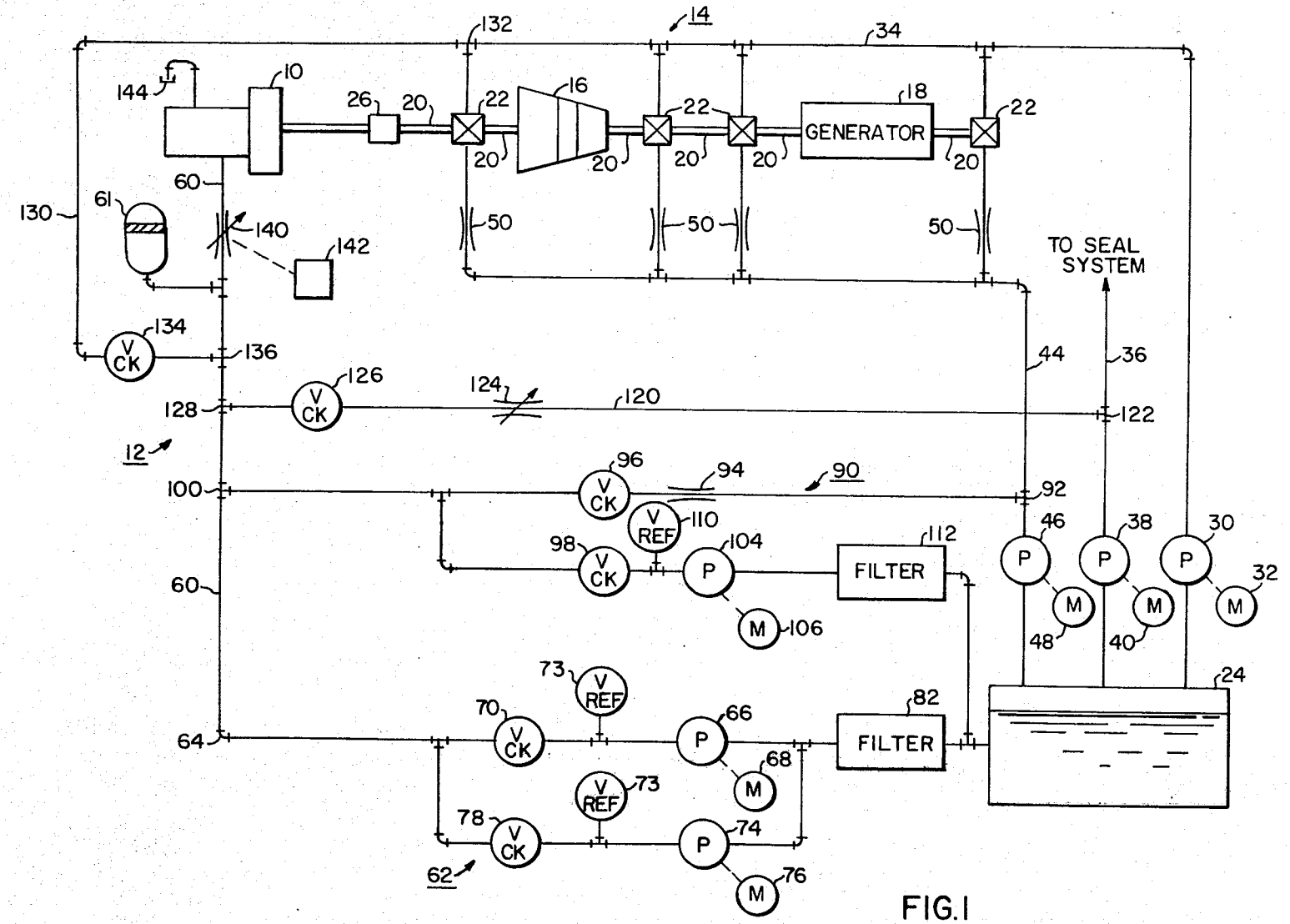
FIG. 1 is a diagrammatic view of a turbine rotor turning system operatively connected directly to the turbine rotor and embodying the teachings of this invention.

Throughout the following description, similar reference characters refer to similar elements in all Figures of the drawings.

Referring first to FIG. 1 of the drawings, illustrated diagrammatically is a turbine shaft turning arrangement embodying the hydraulic motor 10 and hydraulic fluid supply system, generally indicated by reference numeral 12, as taught by this invention. The shaft turning arrangement is shown in the environment of a typical steam turbine power plant, the relevant portions of which are generally indicated by reference numeral 14. The plant 14 includes a steam turbine element 16 and an electrical generator element 18 operatively connected by a shaft 20. The shaft 20 extends centrally and axially through both the turbine element 16 and the generator 18 and is supported at each axial end of each of these mentioned elements by a suitable bearing element 22. Suitable bearing lift arrangements are provided which aid in lifting the shaft 20. Also provided within the generator structure 18, at each axial end thereof, are associated seal arrangements which maintain integrity of the internal environments of the element. As will be seen herein, since the fluid supply systems to the bearings and lift arrangements are of particular relevance, such supply systems will be illustrated, while the physical structure of these arrangements is omitted from FIG. 1 for clarity.

As is well known, the turbine element 16 converts the energy of motive steam introduced thereinto into rotational mechanical energy of the shaft 20. The generator 18, in turn, converts the rotational energy of the shaft 20 to electrical energy for an associated electrical load. In order to meet the lubrication needs of the power plant 14, there is provided a lubricating fluid reservoir 24 and associated conduit arrangements, which will be described completely in relevant detail, and which serves in cooperative association with the fluid supply system 12 for the hydraulic motor 10. As noted above, in order to avoid uneven cooling or heating of the rotating members of the elements of the plant 14, the art provides a turning arrangement operatively connected with the shaft. As outlined, prior art systems are disadvantageous in several respects, and therefore, the turning arrangement embodying the hydraulic motor 10 and fluid supply arrangement 12 are provided to overcome the prior art difficulties. The operative connection between the hydraulic motor 10 and the shaft 20 is provided by any suitable coupling 26.

In order to provide lubricating fluid to the various lubrication systems required by the plant 14, there is provided a conduit arrangement, having necessary pumping, filtering and flow controlling devices therein, which conducts lubricating fluid from the reservoir 24 to the user arrangements. For example, lubricating fluid for use by the bearing members 22 is conducted from a pump 30 driven by a motor 32, via a conduit 34 to the bearings 22. The bearing lubricating fluid is utilized within the bearing members at a relatively low pressure (approximately 30 p.s.i.) and a relatively high flow rate (several hundred g.p.m.). Lubricating fluid for use within the seal arrangement disposed at each axial end of the generator element 18 is provided by a seal oil conduit 36 and a seal oil pump 38 driven by a motor 40. Seal oil flowing within the conduit 36 to the seal system exhibits a pressure of approximately 150 p.s.i. and flows at a rate of several hundred g.p.m. Lubricating fluid utilized by the bearing lifts disposed within the bearing structures 22 is provided by a flow conduit 44 and a pump 46 driven by a motor 48. The lubricating fluid for the lifts, exhibiting a pressure of approximately 1500 p.s.i. and a flow rate of approximately 20 g.p.m., passes through suitable orifices 50 upstream of the lifts. It may thus be appreciated from the foregoing that there is provided, within existing lubrication systems lubricating fluid at a variety of pressure levels and flow rates which are, as will be shown, useful in association with the fluid supply sources for the turning arrangement embodying the teachings of this invention. It is to be noted, that although several fluid conveyance paths have been illustrated and typical pressures and flow rates identified, the description is not to be construed in a limiting sense, but as merely illustrative of the available fluid sources at predetermined pressures and flow rates extant within a typical power plant which may be drawn upon to supply motive fluid to the hydraulic motor turning arrangement disclosed herein.

Again, with reference to FIG. 1, the turbine shaft turning arrangement disclosed herein includes the variable speed, hydraulic motor element 10, and the fluid supply system 12 for providing motive fluid to the motor 10 at a predetermined variety of pressures and flow rates. The motor 10 is constructed such that the torque output thereof is dependent upon the pressure of the motive fluid therethrough. The motor 10, as stated, is coupled through the arrangement 26, to the shaft 20, and imparts thereto torque sufficient to meet the turning requirements thereof. As will be made clear herein, suitable flow control means are provided to selectively introduce motive fluid at the appropriate pressure and flow rate to satisfy the torque and speed requirements of the motor 10.

The motor 10 may be any hydraulic motor of variable speed suitable for producing sufficient torque to meet the initial requirements of torque necessary to move the shaft 20 from rest position. For example, the Hagglunds Hydraulic Motor, manufactured by the Fluid Power Division of Bird-Johnson Company, Walpole, Massachusetts, is a representative motor for use in the turning arrangement disclosed herein. The motor 10 contains an even number of opposed hydraulic pistons which are contained within a suitable housing. The pistons are connected to rollers which bear upon a cam ring. The motive fluid is distributed from the fluid inlet, in a sequential manner to each piston. The fluid pressure forces the pistons, and therefore, the rollers, outward against the cam ring, causing it and the motor casing to rotate. The rotation is transmitted from the motor 10, through the coupling 26, to the shaft 20.

The fluid supply system 12 includes a supply header 60 connected to a plurality of sources of motive fluid, each source being disposed within the power plant 14 and having associated therewith a predetermined pressure and flow rate. Disposed within the supply header 60 adjacent to the hydraulic motor 10 is an accumulator 61 or other suitable energy storage device. The accumulator is charged, as will be shown herein, by fluid taken from each of the supply sources and will provide motive fluid to the motor 10. It is to be understood that the accumulator 61 may be located anywhere within the supply header 60. Each of the motive fluid supply sources connected to and feeding the header 60 and accumulator 61 will be discussed in turn.

The first fluid source 62 uses lubricating oil taken from the lubrication supply reservoir 24 and introduced to the header 60 in a first supply branch 64 connected into the header 60. Fluid is taken from the reservoir 24 and increased in pressure (3000 p.s.i. maximum) by a pump 66 driven by an A.C. motor 68. The fluid passes into the header 60 through a check valve 70 to charge the accumulator 61 with the pressure imparted thereto by the pump 66. Disposed between the valve 70 and the pump 66 is a relief valve 73. An alternate loop may be provided in the case of A.C. power failure. In such a case, fluid from the reservoir 24 changes the accumulator 61 after having been raised to the appropriate pressure by a pump 74 driven by a D.C. motor 76. The alternate D.C. loop has a check valve 78 and a relief valve 73 therein. Of course, fluid entering either the A.C. or the D.C. pump loop is filtered by filter element 82.

It may thus be appreciated that there is then provided high pressure motive fluid for the motor 10 from a source available within the plant 14. The energy imparted to this fluid by the appropriate pump is stored within the accumulator 61 until discharged, in a manner to be described herein, to the header 60 into the motor 10.

A second supply branch 90 is provided to supply motive fluid to the supply header 60 at a second predetermined pressure and flow rate, the pressure being lower than the pressure supplied by the first supply branch 62. This second source of lower pressure motive fluid comprises fluid tapped, at node 92 from the supply conduit 44 of the bearing lift system. This fluid, as stated above, is raised to a pressure of approximately 600 to 1500 p.s.i. by the pump 46 driven by the A.C. motor 48. Fluid conducted from the node 92 passes through a restriction 94 and a check valve 96. The second branch 90 is connected to the supply header 60, as at 100, and fluid at the pressure in conduit 44 discharges into the header 60 and aids in charging the accumulator 61 in a manner to be described. In the case of A.C. power failure, there may be provided a D.C. loop which includes a pump 104 driven by a D.C. motor 106, which passes fluid at the appropriate branch pressure through a check valve 98 into the header 60 and accumulator 61. There is, within the D.C. loop, a relief valve 110. Also provided in the D.C. loop is a filter 112.

A third fluid supply branch 120 is provided to conduct fluid from the seal system, which includes conduit 36, into the supply heater 60. The within the seal conduit 36 is maintained at a pressure of approximately 80 to 150 p.s.i. and is conducted through a tap 22, a variable orifice 124 and a check valve 126 into the supply header 60 and accumulator 61 via a connection 128. A still lower pressure fluid supply branch 130 is provided to conduct fluid from the bearing oil supply conduit 34 via a tap 132 through a check valve 134 and into the header 60 and accumulator 61 through connection 136. As stated earlier, the fluid pressure within the bearing oil conduit is approximately 25 to 30 p.s.i., thus, a low pressure source of motive fluid for the hydraulic motor 10 is connected thereto through the fluid supply system 12. It is noted, of course, that each source supplies the header 60 and charges the accumulator 61 until the check valve in each branch checks that branch out of the charging stream. Also, it is to be noted that alternate configurations may be desired, such as replacement of the accumulator 61 with an accumulator in each flow path, the fluid used to charge each accumulator being introduced into the header 60 (and motor 10) until the check valving checks each supply conduit out of the flow stream. It is also to be noted that if the single accumulator arrangement is used, it may be located at any point in the supply header 60, as long as it is on the discharge side of the check valves and upstream of a variable orifice 140 (described herein).

The variable orifice 140 is disposed within the supply header 60 at the accumulator 61 immediately before the motor 10. The orifice 140 is controlled by a suitable control means 142. The control means 142 provides external control for varying the motor flow capacity and, therefore, the turning speed of the motor 10 and the shaft 20 coupled thereto. By varying the orifice 140, greater or lesser flow rates from the accumulator 61 may be effected, which, as will be seen herein, will affect the motor speed and torque and which will allow one of the supply branches to be called upon to discharge into the supply header 60 to maintain energy for turning the shaft 20. Also, with no alteration of the orifice 140, the torque pressure requirements of the motor 10 affect the flow rate within the header 60, which in turn, determines which one of the supply branches shown may be called upon to discharge to the header 60. Of course, it is to be understood that the origin of the motive fluid, the supply pressure within each of the sources, the source location within the plant 14, and the number of available sources connected into the supply header 60 are disclosed in an illustrative and not in a limiting sense. Fluid discharged from the motor 10 is conducted to a drain, as at 144, and returned to the reservoir 24.

In the prior art, as mentioned previously, the electric motor turning arrangement utilized a constant speed output with gear reduction to provide maximum torques needed for startup and in the event of seal rubs. Once initial startup is achieved, torque requirements of the turning gear decrease, yet the constant speed electric motor continues to operate at a significant power level due to the large friction losses of the gear train. Energy is wasted due to the inefficiency of the geared system. Also, as noted, multiple speed electric motor arrangements may be prohibitively expensive.

Figure 2:
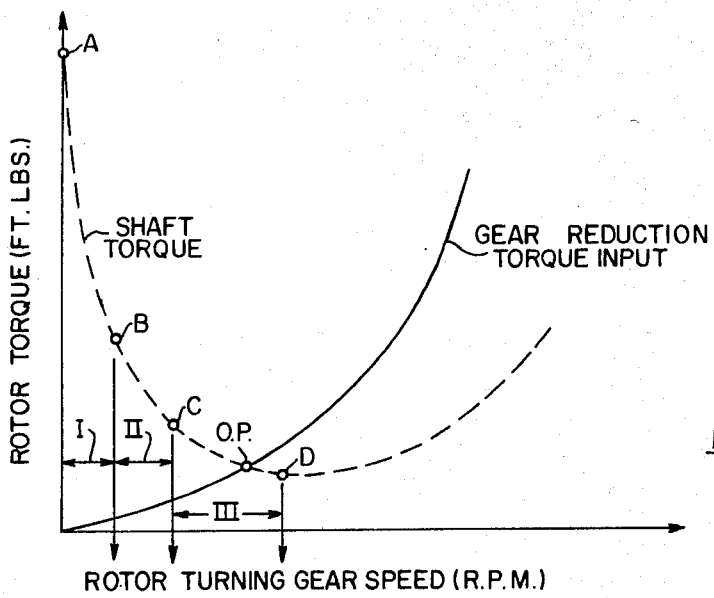
PRIOR ART FIG. 2
FIG. 2 is a graphical interpretation of the torque and speed relationships for a drive motor for a turbine turning gear and having superimposed thereon the operating characteristic of prior art electric motor drives.

With reference to FIG. 2, the torque requirements of the rotor shaft 20 from standstill to slow rolling are indicated by the dashed lines, while the torque input from prior art, gear reduced, electric motors is superimposed in solid lines thereover. As seen, the initial torque requirement for "break away", or to start rolling of the shaft, is indicated at point A and is very large. However, once "break away" is achieved, the torque requirement decreases significantly. The prior art electric motor arrangement is extremely inefficient in that most of the torque developed is needed to drive the reduction gearing and not the shaft. The operating point of prior art systems is indicated by the term "O.P.", on FIG. 2.

The turning arrangement including the variable speed hydraulic motor 10 and the fluid supply system 12 embodying the teachings of this invention operates in a more efficient manner in that only the operating torque required to turn the shaft at a given speed is provided by the applicant's system. As seen in connection with FIG. 3, the characteristic of hydraulic motor inlet pressure and motor inlet flow is exactly similar to the required rotor torque-rotor speed characteristic. Such equivalence enables applicant's system to operate much more efficiently than prior art electrical turning gear arrangements.

Because the hydraulic motor 10 is directly connected to the shaft 20 (see FIG. 1), the motor torque output and motor speed are necessarily the torque inputs to the rotor shaft and the gear speed. Therefore, since the desired work cycle is depicted in FIG. 2, showing the desired rotor torque input and rotor speed, if a system to the motor can supply precisely the desired torque and speed requirements for the rotor, then the task of turning the rotor is more efficiently accomplished.

It is well known that for a positive displacement, directly connected hydraulic motor 10, the torque output of the motor is directly proportional to the motor pressure input. Similarly, the motor speed is directly proportional to the motor flow input. Consequently, to obtain the desired rotor 20 torque and speed output (shown in dashed lines in FIG. 2), it is simply necessary to provide motor 10 pressure and flow inputs corresponding to that shown in FIG. 3. Thus, the torque-speed curve of FIG. 2, since it is identical to the Pressure-Flow curve of FIG. 3 of the directly coupled motor, can be met since it is merely necessary to provide motive fluid input from several predetermined pressure and flow ranges already available within the power plant in accordance with the FIG. 3 characteristic. Various examples will clarify this equivalence.

If, for example, it is required by the rotor torque characteristic of FIG. 2 that a torque of a predetermined magnitude (point A) is to be available at zero speed, i.e., break away, it is simply necessary to provide a pressure input of A lbs. to the motor at zero inlet flow. Meeting the input characteristic of the motor 10 will therefore satisfy the rotor 20 requirements. Similarly, to move the rotor through a range of gear speed I, torques corresponding to values from points A to B on FIG. 2 must be provided. Such torques can be provided if the motor pressure input follows the values shown in FIG. 3 between points A′ to B′, within a flow range I′.

Figure 3:
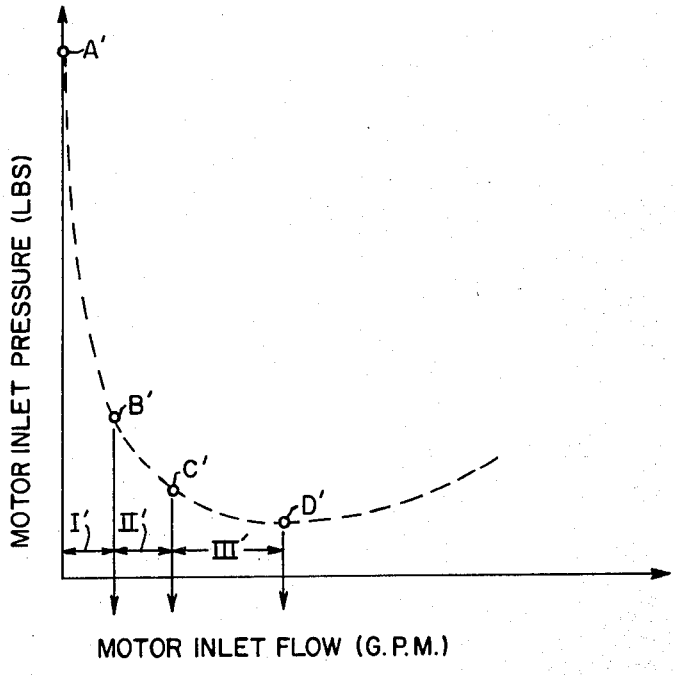
FIG. 3 is the operating characteristic of the hydraulic motor utilized by this invention.

Also, to meet rotor torque requirements between points B to C and speed range II on FIG. 2, it is necessary to provide motor input pressure and flow corresponding to those between B′ and C′ and range II′ on FIG. 3. Also, to provide rotor torque needs from points C to D and speed range III on FIG. 2, it is necessary to provide pressure input valves between points C′ and D′ within flow range III′ to the motor, as shown in FIG. 3. Speed ranges beyond those of range III in FIG. 2 simply are not necessary, since these values are beyond rotor turning requirements.

Applicant's system then simply provides motor pressure and flow sources, taken from various sources within the power plant, and inputs these sources selectively into the motor 10 in order to accurately and efficiently provide the required rotor torque and speed requirements. It is clear that applicant's system is much more efficient than that of the prior art. By the selective introduction of motive fluid at predetermined pressures and flow rates, the rotor torque and speed output can be tailored to fit the desired characteristic. This principle, adapted to the system of FIG. 1, may be seen to reach the required result from the following discussion.

As seen from reference to FIG. 1, the hydraulic turning arrangement there depicted utilizes existing turbine plant lubrication systems at four distinct source pressures and flows to provide hydraulic motive fluid to the motor 10. For startup, or breakaway (Point A on FIG. 2) fluid pressure of 3000 p.s.i. within the accumulator 61 and charged to the first supply branch 62 enters the header 60. Since the fluid within the header 60 then has a pressure of approximately 3000 p.s.i., fluid from within the other supply branches is prohibited from entering header 60 by the check valves disposed in the other supply branch. The fluid at the highest pressure is conducted to the motor 10 and the torque output of the motor 10 increases with increasing inlet pressure until rotor shaft break-away occurs.

Upon shaft break-away and the initiation of shaft rotation, the required turning torque decreases, pressure decreases with torque, and the motor 10 accelerates. The accumulator 61 discharges fluid to the motor 10, through the header 60, at decreasing pressure as the flow to the motor 10 increases with increasing speed. As the pressure drops, the second supply branch 90, at a lower pressure (approximately 1700 p.s.i.), but with increased flow capability, discharges into the header 60 through the check valve 98. Similarly, pressurized fluid from the third supply branch 120 is discharged into the head 60 through the check valve 126 as fluid from the accumulator 61 is depleted and the fluid pressure within the header 60 decreases. When the fourth supply branch 130, having pressurized fluid from the lowest system pressure (approximately 30 p.s.i.) discharges, through the valve 134 into the header 60, the motor speed remains constant and fluid is supplied thereto from the lubrication system pump 30 at lower pressures. The speed of the motor 10 may also be varied by regulating the flow through the orifice 140.

At turning speeds, only about 2 to 5 horsepower is required by the pump 30 of the bearing oil system to maintain rotation for the largest turbines. Since the high pressure pump 66 is utilized for starting when flow to the motor is zero, the pump 66 may be very small, with a small power requirement. This is to be contrasted with the inefficient and large power requirements of prior art systems.

As seen, FIG. 1 illustrates the direct drive configuration in which the motor 10 is coupled directly to the shaft 20 by the coupling 26. Such a direct connection is made possible by the efficiency of the low speed hydraulic system taught herein. The advantages of such a system are many. There are required no gear drives and no speed reduction. Thus, the motor 10 engages with the shaft 20 with ease. There is very low motor speed and relatively low flow required. Higher output torques relative to lower horsepower inputs are achieved. Also, due to the simplicity of the system, it is, at the same time, less costly and more reliable. Unlike the prior art electric motor drives, the hydraulic motor's torque is variable throughout the operating range. Yet, an emergency, such as seal rubs which have a high torque requirement, the hydraulic supply system automatically increases pressure to maintain rotation at a reduced speed.

Figure 4:
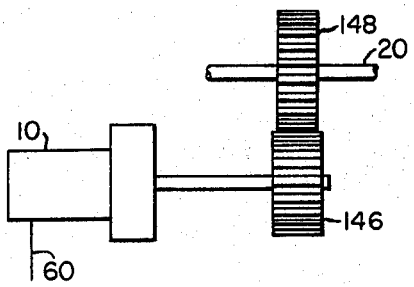
FIG. 4 is a diagrammatic view of another embodiment of the invention.

As seen from the embodiment shown in FIG. 4, the hydraulic arrangement described heretofore is compatible with the prior art gear drives, if desired, thus adding to flexibility of design. By providing a pinion gear 146 on the hydraulic motor 10, and enmeshing the gear 146 with a turning gear 148 of standard availability mounted to the shaft 20, most of the previously discussed advantages are available. In addition, higher output torques due to the mechanical advantage of the geared drive are obtained.

It is understood that although numerous changes may be made in the above-described arrangement and different embodiments thereof may be made without departing from the spirit of the invention as described in the appended claims, it is intended that all matter contained in the foregoing description or shown in the accompanying drawings shall be interpreted as illustrative and not in a limiting sense.

I claim as my invention:

1. An arrangement for turning a rotor shaft of an axial flow elastic fluid turbine apparatus, said turning arrangement comprising:

a variable speed hydraulic motor, the torque output thereof being dependent upon the pressure of motive fluid supplied thereto;

means for coupling said hydraulic motor to said rotor shaft;

a plurality of motive fluid sources in fluid communication with said motor, each source having a predetermined pressure range and flow rate associated therewith;

a supply header connected to said hydraulic motor and to each of said sources of motive fluid, said supply header having an accumulator therein;

a variable flow constrictor disposed within said supply header, said flow constrictor adapted to alter the pressure and flow rate of motive fluid within said supply header from each of said sources of motive fluid; and flow control means for selectively permitting communication between said plurality of motive fluid sources and the hydraulic motor to thereby introduce motive fluid at a predetermined pressure and flow rate to said motor to produce predetermined torque outputs therefrom.

2. The turning arrangement of claim 1, wherein said turbine is disposed within a power generation facility including a lubricating fluid reservoir therein; wherein one of said plurality of fluid sources comprises:

a branch conduit connecting said lubricating fluid reservoir to said supply header;

pump means for pumping lubricating fluid from said lubricating fluid reservoir into said header and said accumulator to charge said accumulator to a predetermined pressure;

and wherein said flow control means comprises a valve device disposed within said branch conduit, said valve device permitting lubricating fluid to flow into said supply header when the pressure of motive fluid within said supply header is less than the predetermined pressure of motive fluid within said supply conduit.

3. The turning arrangement of claim 1, wherein said turbine has associated therewith a bearing lift system and means for supplying lubricating fluid; at a predetermined pressure to said bearing lift system; wherein one of said plurality of sources of motive fluid comprise:

a branch conduit connecting said bearing lift supply means to said supply header;

and wherein said flow control means comprises a valve device disposed within said branch conduit, said valve device being operable to permit fluid to flow from said branch conduit into said supply header when the pressure of fluid within said supply header is less than the pressure of fluid within said branch conduit.

4. The turning arrangement of claim 2, wherein said turbine has associated therewith a bearing lift system and means for supplying lubricating fluid to said bearing lift system; and wherein another of said plurality of fluid sources comprises:

a second branch conduit connecting said bearing lift supply means with said supply header;

wherein said flow control means comprises a second valve device disposed within said second branch conduit, said second valve device being operable to permit fluids from said second branch conduit to discharge into said supply header when the pressure of fluid within said supply header is less than the pressure of the fluid within said second branch conduit;

and wherein said second pressure is less than said first pressure.

5. The turning arrangement of claim 1 wherein said turbine has associated therewith a seal system and means for supplying sealing fluid to said sealing system; wherein one of said plurality of fluid sources comprises:

a branch conduit connected between said seal system supply means and said supply header, said branch conduit containing fluid at a pressure maintained by said seal system supply means;

and wherein said flow control means comprises a valve device disposed within said branch conduit, said valve device being operable to permit fluid to flow from said branch conduit into said supply header when the pressure of fluid within said supply header is less than the pressure of the fluid maintained by said seal system supply means.

6. The turning arrangement of claim 4, wherein said turbine has associated therewith a seal system and means for supplying fluid to said sealing system; wherein another of said plurality of supply sources comprises:

a third branch conduit connected between said seal system supply means and said supply header, said fluid within said third branch conduit having a predetermined pressure maintained by said seal system supply means;

wherein said flow control means comprises a third valve device disposed within said third branch conduit, said third valve device being operable to permit fluid within said third branch conduit to discharge into said supply header when the pressure of fluid within said supply header is less than the pressure of fluid maintained by said seal system supply means;

and wherein said third predetermined pressure is less than said second predetermined pressure.

7. The turning arrangement of claim 1, wherein said turbine has associated therewith bearing members for rotatably supporting said shaft and means for supplying lubricating fluid to said bearing members; wherein one of said plurality of fluid sources comprises:

a branch of conduit disposed between said bearing member supply means and said supply header, said fluid within said branch conduit having a pressure maintained by said bearing member supply means;

and wherein said flow control means comprises a valve device disposed within said branch conduit and operable to permit communication between said branch conduit and said supply header when the pressure of fluid within said supply header is less than the pressure of fluid within said branch conduit maintained by said bearing member supply means.

8. The turning arrangement of claim 6, wherein said turbine has associated therewith bearing members for rotatably supporting said shaft, and means for supplying fluid to said bearing members; wherein another of said plurality of fluid sources comprises:

a fourth branch conduit disposed between said bearing member supply means and said supply header, said fluid within said fourth branch conduit being maintained at a pressure by said bearing member supply means; and wherein said flow control means comprises a fourth valve device disposed within said fourth branch conduit, said fourth valve device being operable to permit fluid from within said fourth branch conduit to be discharged into said supply header when the pressure of fluid within said supply header is less than the temperature of the fluid within said fourth branch conduit maintained by said bearing member supply means.

9. An arrangement for rotating a turning gear mounted on a rotor shaft of an axial flow turbine apparatus, said arrangement comprising:

a variable speed hydraulic motor, the torque output thereof being dependent upon the pressure of a motive fluid supplied thereto;

gear means mounted to said hydraulic motor and engageable with said turning gear mounted on said rotor shaft;

a plurality of sources of motive fluid in fluid communication with said hydraulic motor, each source having a predetermined pressure and flow rate associated therewith;

a supply header connected to said hydraulic motor and to each of said sources of motive fluid, said supply header having an accumulator therein;

a variable flow constrictor disposed within said supply header, said flow constrictor adapted to alter the pressure and flow rate of motive fluid within said supply header from each of said sources of motive fluid; and flow control means for selectively permitting communication between said plurality of motive fluid sources and said hydraulic motor to thereby introduce motive fluid at a predetermined pressure and flow rate to said motor to produce predetermined torque outputs therefrom.

10. The turning arrangement of claim 9, wherein said turbine is disposed within a power generation facility including a lubricating fluid reservoir therein; wherein one of said plurality of fluid sources comprises:

a branch conduit connecting said lubricating fluid reservoir to said supply header;

pump means for pumping lubricating fluid from said lubricating fluid reservoir into said header and said accumulator to charge said accumulator to a predetermined pressure;

and wherein said flow control means comprises a valve device disposed within said branch conduit, said valve device permitting lubricating fluid to flow into said supply header when the pressure of motive fluid within said supply header is less than the predetermined pressure of motive fluid within said supply conduit.

11. The turning arrangement of claim 9, wherein said turbine has associated therewith a bearing lift system and means for supplying lubricating fluid at a predetermined pressure to said bearing lift system; wherein one of said plurality of sources of motive fluid comprises:

a branch conduit connecting said bearing lift supply means to said supply header;

and wherein said flow control means comprises a valve device disposed within said branch conduit, said valve device being operable to permit fluid to flow from said branch conduit into said supply header when the pressure of fluid within said supply header is less than the pressure of fluid within said branch conduit.

12. The turning arrangement of claim 10, wherein said turbine has associated therewith a bearing lift system and means for supplying lubricating fluid to said bearing lift system; wherein another of said plurality of fluid sources comprises:

a second branch conduit connecting said bearing lift supply means with said supply header;

wherein said flow control means comprises a second valve device disposed within said second branch conduit, said second valve device being operable to permit fluids from said second branch conduit to discharge into said supply header when the pressure of fluid within said supply header is less than the pressure of the fluid within said second branch conduit;

and wherein said second pressure is less than said first pressure.

13. The turning arrangement of claim 9, wherein said turbine has associated therewith a seal system and means for supplying sealing fluid to said sealing system; wherein one of said plurality of fluid sources comprises:

a branch conduit connected between said seal system supply means and said supply header, said branch conduit containing fluid at a pressure maintained by said seal system supply means;

and wherein said flow control means comprises a valve device disposed within said branch conduit, said valve device being operable to permit fluid to flow from said branch conduit into said supply header when the pressure of fluid within said supply header is less than the pressure of the fluid maintained by said seal system supply means.

14. The turning arrangement of claim 12, wherein said turbine has associated therewith a seal system and means for supplying fluid to said sealing system; wherein another of said plurality of supply sources comprises:

a third branch conduit connected between said seal system supply means and said supply header, said fluid within said third branch conduit having a predetermined pressure maintained by said seal supply means;

wherein said flow control means comprises a third valve device disposed within said third branch conduit, said third valve device being operable to permit fluid within said third branch conduit to discharge into said supply header when the pressure of fluid within said supply header is less than the pressure of fluid maintained by said seal system supply means;

and wherein said third predetermined pressure is less than said second predetermined pressure.

15. The turning arrangement of claim 9, wherein said turbine has associated therewith bearing members for rotatably supporting said shaft and means for supplying lubricating fluid to said bearing members, wherein one of said plurality of fluid sources comprises:

a branch conduit disposed between said bearing member supply means and said supply header, said fluid within said branch conduit having a pressure maintained by said bearing member supply means;

and wherein said flow control means comprises a valve device disposed within said branch conduit and operable to permit communication between said branch conduit and said supply header when the pressure of fluid within said supply header is less than the pressure of fluid within said branch conduit maintained by said bearing member supply means.

16. The turning arrangement of claim 14 wherein said turbine has associated therewith bearing members for rotatably supporting said shaft, and means for supplying fluid to said bearing members; wherein another of said plurality of fluid sources comprises:

a fourth branch conduit disposed between said bearing member supply means and said supply header, said fluid within said fourth branch conduit being maintained at a pressure by said bearing member supply means; and wherein said flow control means comprises a fourth valve device disposed within said fourth branch conduit, said fourth valve device being operable to permit fluid from within said fourth branch conduit to be discharged into said supply header when the pressure of fluid within said supply header is less than the pressure of the fluid within said fourth branch conduit maintained by said bearing member supply means.

* * * * *